US010495384B2

(12) United States Patent
Rock, Jr. et al.

(10) Patent No.: US 10,495,384 B2
(45) Date of Patent: Dec. 3, 2019

(54) COUNTER-FLOW HEAT EXCHANGER WITH HELICAL PASSAGES

(71) Applicant: General Electric Company, Schenectady, NY (US)

(72) Inventors: Peter Joseph Rock, Jr., Boston, MA (US); Matthew Goldenberg, Medford, MA (US); Lauren Ashley Henning, Boston, MA (US); Jeffrey Miles McMillen Prescott, Somerville, MA (US); Kevin Robert Shannon, Boston, MA (US)

(73) Assignee: General Electric Company, Schenectady, NY (US)

( * ) Notice: Subject to any disclaimer, the term of this patent is extended or adjusted under 35 U.S.C. 154(b) by 496 days.

(21) Appl. No.: 14/813,272

(22) Filed: Jul. 30, 2015

(65) Prior Publication Data

US 2017/0030651 A1 Feb. 2, 2017

(51) Int. Cl.
*F28F 9/02* (2006.01)
*F28D 7/02* (2006.01)
(Continued)

(52) U.S. Cl.
CPC ..... *F28D 7/022* (2013.01); *F28D 7/0008* (2013.01); *F28F 1/06* (2013.01); *F28F 7/02* (2013.01);
(Continued)

(58) Field of Classification Search
CPC ..... F28D 7/02; F28D 7/022; F28D 7/0033; F28D 7/0008; F28D 7/024; F28D 7/04;
(Continued)

(56) References Cited

U.S. PATENT DOCUMENTS 2,014,919 A 9/1935 Zellhoefer
2,653,014 A * 9/1953 Sniader ..... F25D 31/002 165/140
(Continued)

FOREIGN PATENT DOCUMENTS

CN 102667392 A 9/2012
EP 2771637 A 9/2014
(Continued)

OTHER PUBLICATIONS

European Search Report and Written Opinion issued in connection with corresponding EP Application No. 16179895.4 dated Nov. 28, 2016.
(Continued)

*Primary Examiner* — Henry T Crenshaw
*Assistant Examiner* — Kamran Tavakoldavani
(74) *Attorney, Agent, or Firm* — Dority & Manning, P.A.

(57) ABSTRACT

A counter-flow heat exchanger is provided that includes: a first fluid path having a first supply tube connected to a first transition area separating the first fluid path into a first array of first passageways, with the first array of first passageways merging at a first converging area into a first discharge tube; and a second fluid path having a second supply tube connected to a second transition area separating the second fluid path into a second array of second passageways, with the second array of second passageways merge at a second converging area into a second discharge tube. The first passageways and the second passageways have a substantially helical path around the centerline of the counter-flow heat exchanger. Additionally, the first array and the second array are arranged together such that each first passageway is adjacent to at least one second passageway.

20 Claims, 5 Drawing Sheets

(51) Int. Cl.
*F28F 7/02* (2006.01)
*F28D 7/00* (2006.01)
*F28F 1/06* (2006.01)

(52) U.S. Cl.
CPC ..... *F28D 7/0033* (2013.01); *F28F 2210/02* (2013.01); *F28F 2255/00* (2013.01)

(58) Field of Classification Search
CPC ..... F28D 7/028; F28F 1/36; F28F 7/02; F28F 2255/00; F28F 1/06; F28F 2210/02; F28F 9/0275; F28F 9/026; F28F 9/0263
See application file for complete search history.

(56) References Cited

U.S. PATENT DOCUMENTS

| | | | | |
|---|---|---|---|---|
| 3,805,890 | A | 4/1974 | Boardman et al. | |
| 3,907,028 | A | 9/1975 | Lawson | |
| 4,168,745 | A | 9/1979 | Lastinger | |
| 4,215,743 | A | 8/1980 | Margittai | |
| 4,421,702 | A | 12/1983 | Oda et al. | |
| 4,451,960 | A | 6/1984 | Molitor | |
| 4,852,644 | A | 8/1989 | Schlemenat et al. | |
| 4,893,672 | A * | 1/1990 | Bader | F28D 7/024 165/163 |
| 5,164,128 | A | 11/1992 | Modrek et al. | |
| 5,394,937 | A * | 3/1995 | Nieh | F28D 7/103 165/108 |
| 6,170,568 | B1 * | 1/2001 | Valenzuela | F28D 9/0012 165/166 |
| 7,322,403 | B2 | 1/2008 | Agee | |
| 7,597,136 | B2 | 10/2009 | Kite et al. | |
| 7,810,552 | B2 | 10/2010 | Slaughter | |
| 7,866,377 | B2 | 1/2011 | Slaughter | |
| 7,871,578 | B2 | 1/2011 | Schmidt | |
| 2006/0124285 | A1 | 6/2006 | Kite et al. | |
| 2012/0006670 | A1 * | 1/2012 | Kamen | B01D 1/0082 202/185.1 |
| 2013/0071594 | A1 * | 3/2013 | Bikson | F28D 15/00 428/36.9 |
| 2013/0206374 | A1 | 8/2013 | Roisin et al. | |
| 2013/0233526 | A1 | 9/2013 | Hislop | |
| 2014/0284038 | A1 | 9/2014 | Vedula et al. | |
| 2014/0318748 | A1 | 10/2014 | Svensson et al. | |
| 2015/0176912 | A1 * | 6/2015 | Tsuji | B23P 15/26 165/163 |

FOREIGN PATENT DOCUMENTS

| | | | |
|---|---|---|---|
| GB | 588520 | A | 5/1947 |
| JP | 5188866 | U | 7/1976 |
| JP | 62268990 | A | 11/1987 |
| JP | 2003254684 | A | 9/2003 |
| JP | 2003336984 | A | 11/2003 |
| JP | 2005-147566 | A | 6/2005 |
| JP | 2005331121 | A | 12/2005 |
| JP | 2006234254 | A | 9/2006 |
| WO | 2006064202 | A1 | 6/2006 |
| WO | 2008047096 | A1 | 4/2008 |
| WO | 2013/063359 | A1 | 5/2013 |
| WO | 2013/163398 | A1 | 10/2013 |

OTHER PUBLICATIONS

First Office Action and Search issued in connection with corresponding CN Application No. 201610610074.6 dated Jan. 12, 2018.
Machine translation and Office Action issued in connection with Corresponding JP Application No. 2016143857 dated Oct. 31, 2017.

* cited by examiner

COUNTER-FLOW HEAT EXCHANGER WITH HELICAL PASSAGES

FIELD OF THE INVENTION

The present invention relates generally to a counter-flow heat exchanger. In particular embodiments, the counter-flow heat exchanger uses helical passages and transitions from single circular inlet and outlet tubes to multiple passageways with non-circular geometries.

BACKGROUND OF THE INVENTION

Heat exchangers may be employed in conjunction with gas turbine engines. For example, a first fluid at a higher temperature may be passed through a first passageway, while a second fluid at a lower temperature may be passed through a second passageway. The first and second passageways may be in contact or close proximity, allowing heat from the first fluid to be passed to the second fluid. Thus, the temperature of the first fluid may be decreased and the temperature of the second fluid may be increased.

Counter-flow heat exchangers provide a higher efficiency than cross-flow type heat exchangers, and are particularly useful when the temperature differences between the heat exchange media are relatively small. Conventional heat exchangers with a plurality of tubes have drawbacks with regard to the connection and formation of numerous inaccessible tubes with small spacing.

The helical tubes must be arrayed without interruption in order to form a closed helical flow channel and to thereby ensure operation in true countercurrent flow with high efficiency. However, the assembly of tube bundles with contiguous helical tubes and their connection become particularly problematic as the number of tubes increases and were hitherto at best possible with a very small number of helical tubes.

As already mentioned, the manufacture of tube bundles of this type becomes particularly problematic when the number of tubes is increased inasmuch as the connection of the contiguous tubes becomes particularly difficult due to the inaccessibility of the tube ends and therefore is not possible with conventional connecting means. It is further particularly difficult to bend rigid tubes into exactly contiguous coils and to connect them by conventional connecting means.

BRIEF DESCRIPTION OF THE INVENTION

Aspects and advantages of the invention will be set forth in part in the following description, or may be obvious from the description, or may be learned through practice of the invention.

A counter-flow heat exchanger is generally provided. In one embodiment, the counter-flow heat exchanger comprises: a first fluid path having a first supply tube connected to a first transition area separating the first fluid path into a first array of first passageways, with the first array of first passageways merging at a first converging area into a first discharge tube; and a second fluid path having a second supply tube connected to a second transition area separating the second fluid path into a second array of second passageways, with the second array of second passageways merge at a second converging area into a second discharge tube. The first passageways and the second passageways have a substantially helical path around the centerline of the counter-flow heat exchanger. Additionally, the first array and the second array are arranged together such that each first passageway is adjacent to at least one second passageway.

In one embodiment, the first transition area is positioned at one end of the helical path to supply a first fluid stream into the first array of first passageways, and wherein the second transition area is configured at an opposite end of the helical path to supply a second fluid stream into the second array of second passageways such that the first fluid stream and the second fluid stream circulate the helical path in opposite directions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
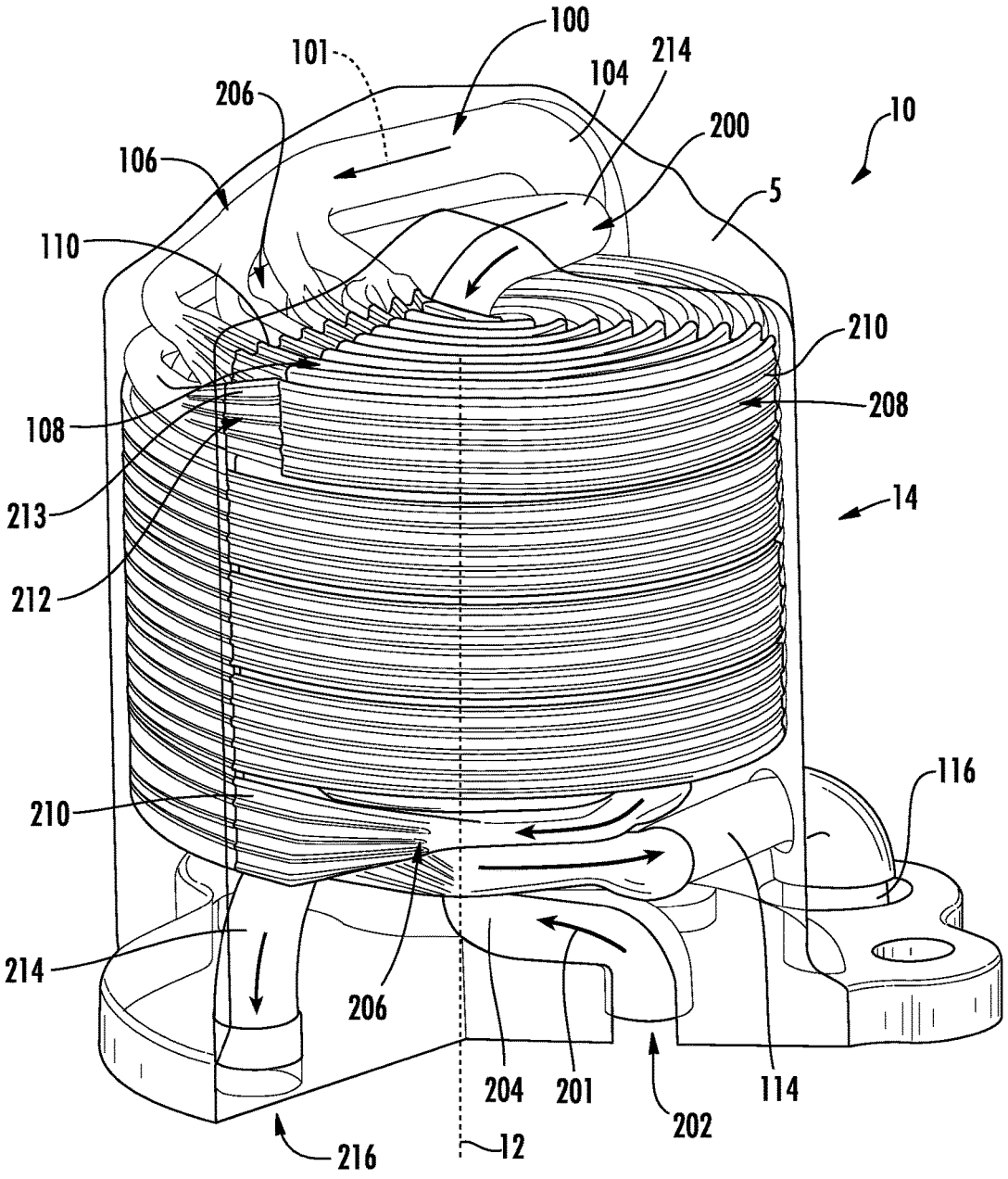
FIG. 1 is a perspective view of an exemplary counter-flow heat exchanger, according to one embodiment.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, a "fluid" may be a gas or a liquid. The present approach is not limited by the types of fluids that are used. In the preferred application, the cooling fluid is fuel, and the cooled fluid is oil. For example, the oil can be cooled from an initial temperature to a discharge temperature, with the discharge temperature being about 90% of the initial temperature or lower (e.g., about 50% to about 90% of the initial temperature). The present approach may be used for other types of liquid and gaseous fluids, where the cooled fluid and the cooling fluid are the same fluids or different fluids. Other examples of the cooled fluid and the cooling fluid include air, hydraulic fluid, combustion gas, refrigerant, refrigerant mixtures, dielectric fluid for cooling avionics or other aircraft electronic systems, water, water-based compounds, water mixed with antifreeze additives (e.g., alcohol or glycol compounds), and any other organic or inorganic heat transfer fluid or fluid blends capable of persistent heat transport at elevated or reduced temperature.

A heat exchanger is generally provided that includes performance-enhancing geometries whose practical implementations are facilitated by additive manufacturing. Although the heat exchanger system described herein is broadly applicable to a variety of heat exchanger applications involving multiple fluid types, it is described herein for its high-effectiveness cooling of an engine oil (e.g., the hot stream) with a fuel (e.g., the cold stream).

Generally, the counter-flow heat exchanger features a pair of single inlet tubes transitioning to multiple helical passage ways then transitioning to single outlet tubes. The multiple passageways generally define non-circular geometries, so as to increase the surface area available for thermal exchange. Advantageously, the counter-flow heat exchanger is formed via additive manufacturing as a single component that requires no additional assembly.

Figure 2:
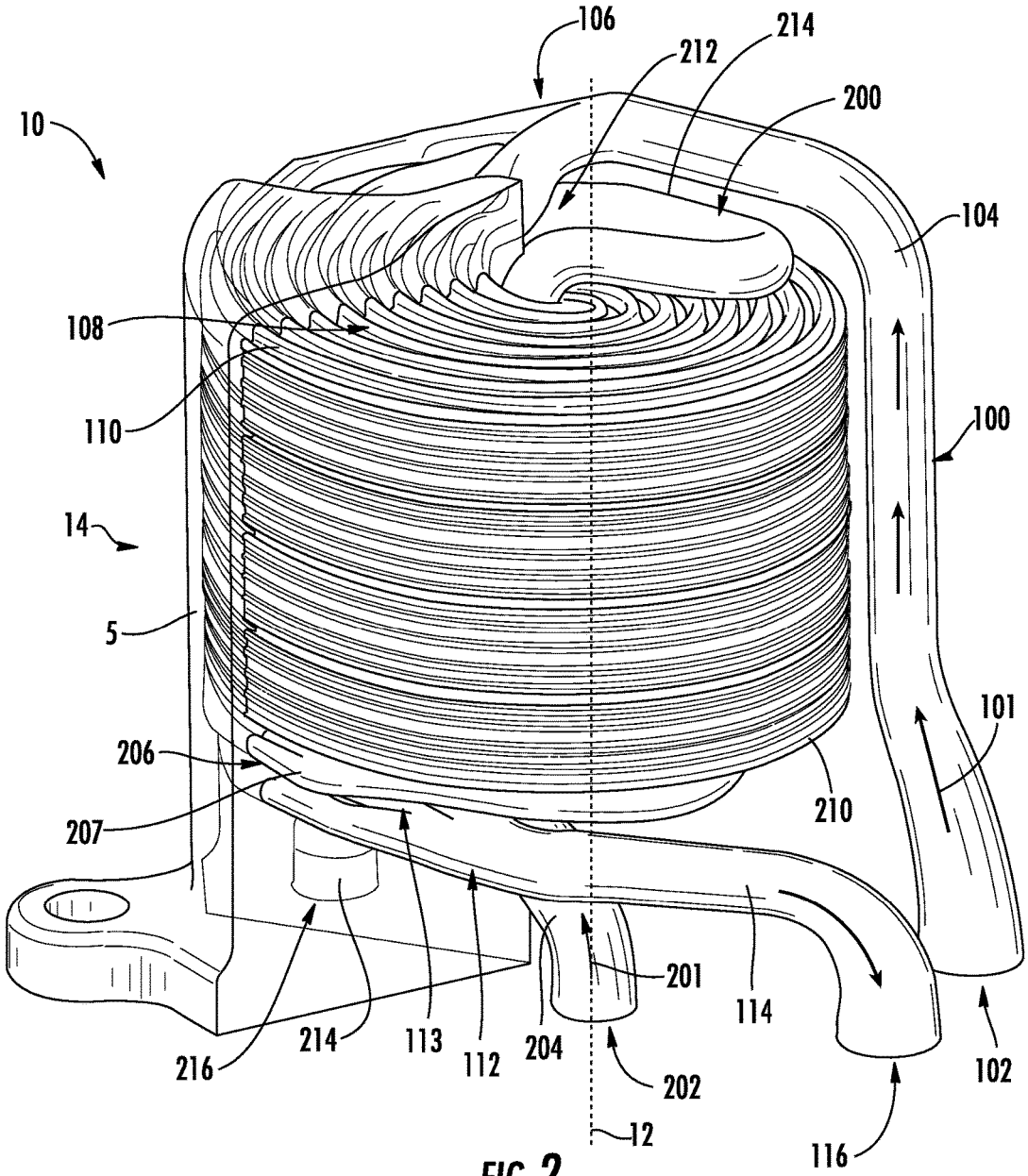
FIG. 2 another perspective view of the exemplary counter-flow heat exchanger shown in FIG. 1.

Referring to FIGS. 1 and 2, an exemplary counter-flow heat exchanger 10 is generally shown. The heat exchanger 10 includes a first fluid path 100 and a second fluid path 200 that are separated from each other in that the respective fluids do not physically mix with each other. However, heat transfer occurs between the fluids within the first fluid path 100 and the second fluid path 200 through the surrounding walls as they flow in opposite directions, effectively cooling the hot stream by transferring its heat to the cold stream. It is noted that the first fluid path 100 is discussed as containing the hot stream therein, and the second fluid path 200 is discussed as containing the cold stream therein. However, it is noted that the first fluid path 100 or the second fluid path 200 can contained either the hot stream or the cold stream, depending on the particular use. Thus, the following description is not intended to limit the first fluid path 100 to the hot stream and the second fluid path 200 to the cold stream.

Referring now to the first fluid path 100, a hot inlet 102 is shown supplying a hot fluid stream 101 into the first fluid path 100. As it enters through the hot inlet 102, the hot fluid stream 101 travels through the first supply tube 104 to a first transition area 106. The first supply tube 104 is generally shown cylindrical (e.g., having a circular cross-section); however, the first supply tube 104 can have any suitable geometry for supplying the hot fluid stream 101 into the heat exchanger 10.

Figure 3:
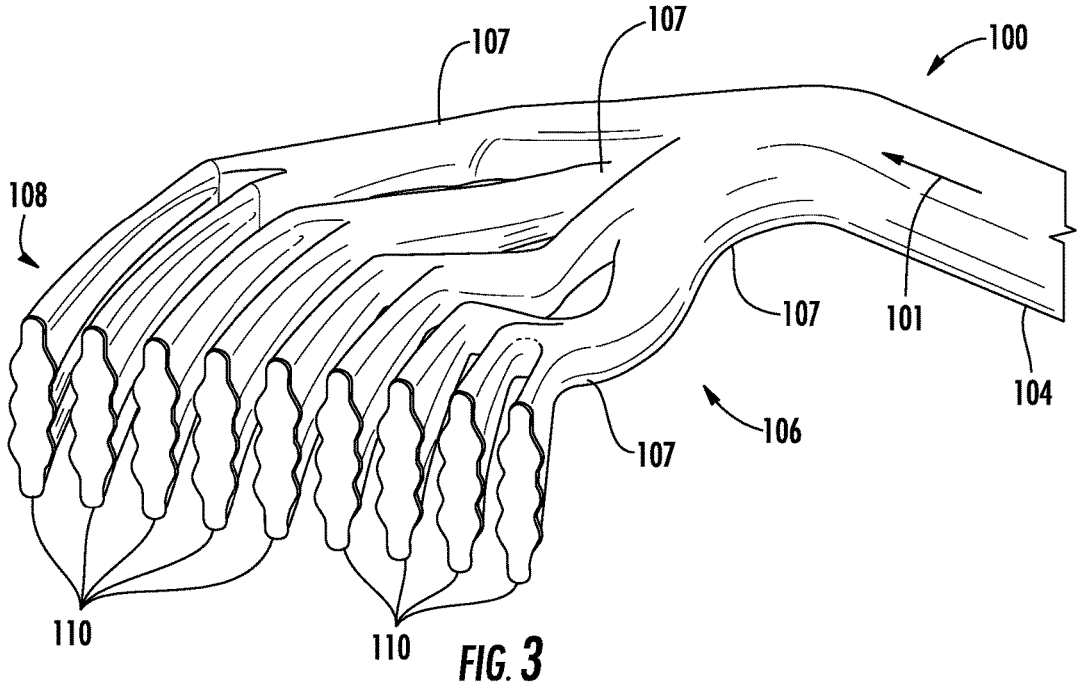
FIG. 3 shows a cross-sectional view of a transition portion of the exemplary counter-flow heat exchanger to one embodiment of FIG. 1.

FIG. 3 shows that the hot fluid stream 101 travels into the first transition area 106 and branches into a first array 108 of first passageways 110. Specifically, the first transition area 106 defines a plurality of branches 107 that sequentially separate the first fluid path 100 from the first supply tube 104 into the first array 108 of first passageways 110. The first transition area 106 is shown as being an anatomically inspired design in that a single supply tube 104 (i.e., an artery) is divided into a plurality of smaller passageways 110 (i.e., the veins) that have a different cross-sectional shape.

Referring again to FIGS. 1 and 2, the first array 108 of first passageways 110 generally follows a helical path around a centerline 12 of the heat exchanger 10. Although shown making four passes around the centerline 12 (i.e., orbits) in the helical path, any number of orbits may form the helical path. Then, the first array 108 of first passageways 110 merge at a first converging area 112 after following the helical path around the centerline 12 into a first discharge tube 114. The first converging area 112 is similar to the first transition area 106 in that the first array 108 of first passageways 110 converge back into a single tube that is the first discharge tube 114. Thus, the first converging area 112 defines a plurality of merging areas 113. Then, the hot stream 101 passes through the first discharge tube 114 and out of a first exit 116.

Conversely, the second fluid path 200 defines a cold inlet 202 that supplies a cold fluid stream 201 into the second fluid path 200. As it enters through the cold inlet 202, the cold fluid stream 201 travels through the second supply tube 204 to a second transition area 206. The second supply tube 204 is generally shown generally cylindrical (e.g., having a circular cross-section); however, the second supply tube 204 can have any suitable geometry for supplying the cold fluid stream 201 into the heat exchanger 10. Similar to the first transition area 106 of the first fluid path 100, the second transition area 206 of the second flow path 200 defines a plurality of forks that sequentially separated the second fluid path 200 from the second supply tube 204 into a second array 208 of second passageways 210. The second array 208 of second passageways 210 generally follows a helical path around a centerline 12 of the heat exchanger 10.

The second array 208 of second passageways 210 merge at a second converging area 212 after following the helical path around the centerline 12 into a second discharge tube 214. The second converging area 112 is similar to the second transition area 206 in that the second array 208 of second passageways 210 converge back into a single tube that is the second discharge tube 214. Thus, the second converging area 212 defines a plurality of merging areas 213. Then, the cold stream 201 passes through the second discharge tube 214 and out of a second exit 216. As shown, the second discharge tube 214 travels through the center of the heat exchanger 10 to carry the cold stream 201 down the centerline 12 prior to passing through the second exit 216.

Through this configuration, the first fluid stream 101 and the second fluid stream 201 travel in opposite directions in their respective passageways 110, 210 in order to have a counter-flow orientation with respect to the direction of flow of the first fluid stream 101 and the second fluid stream 201 in the helical section 14. However, in an opposite embodiment, the heat exchanger 10 can be designed such that the first fluid stream 101 and the second fluid stream 201 travel in the same direction in their respective passageways 110, 210.

Figure 4:
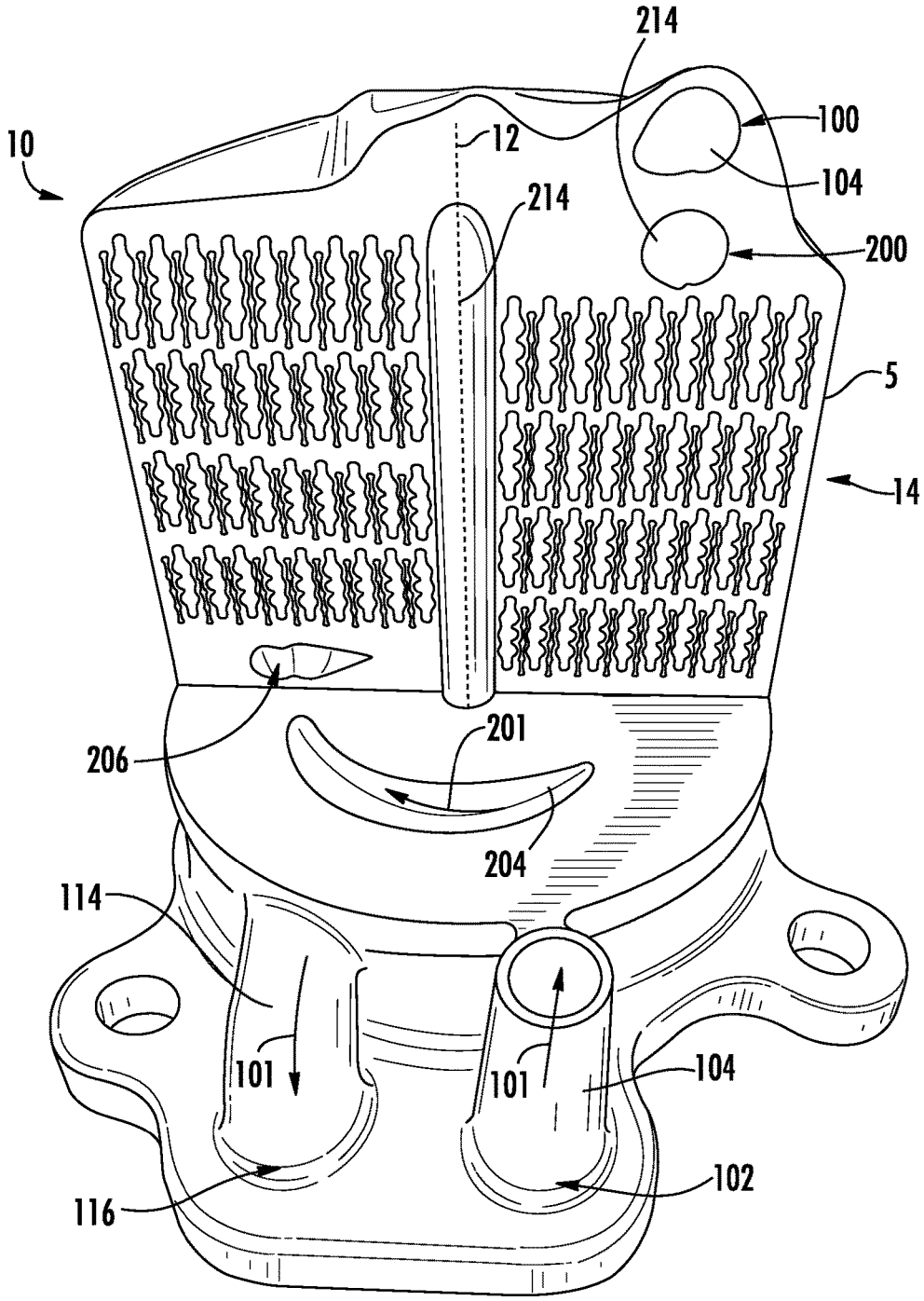
FIG. 4 shows a cut-away view of the exemplary counter-flow heat exchanger shown in FIG. 1.
Figure 5:
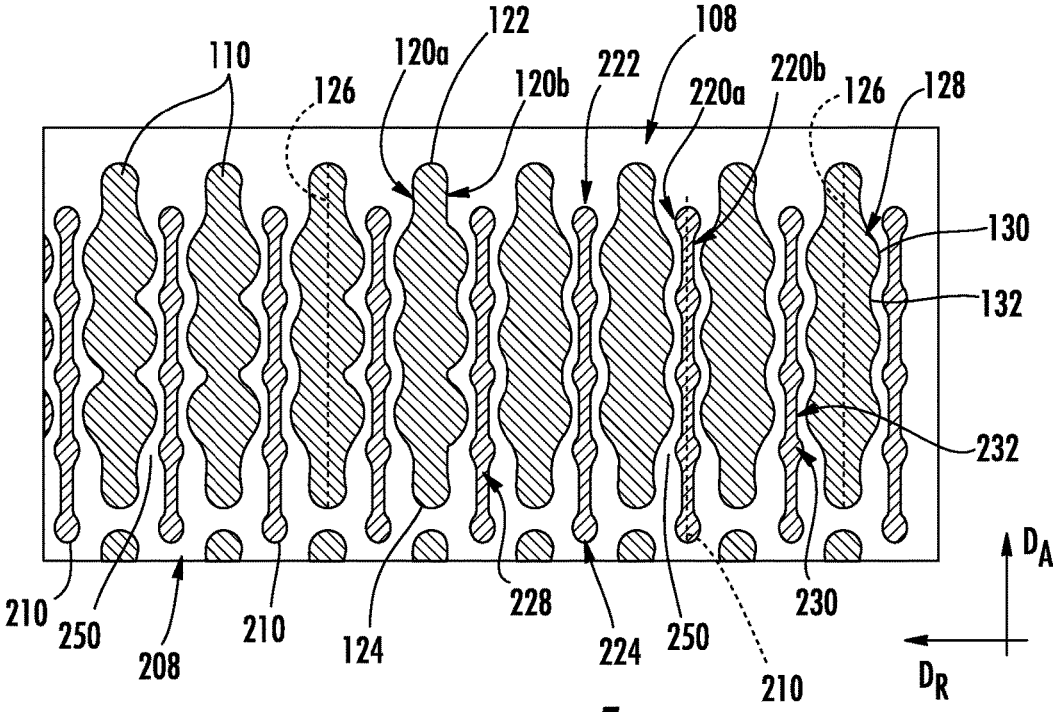
FIG. 5 shows an exploded, cross-sectional view of the heat exchanger portion according to the embodiment of FIG. 4.

FIGS. 4 and 5 show a cross-sectional view in a plane defined by the axial direction $D_A$ (that is in the direction of the centerline 12) and the radial direction $D_R$ (that is in a direction perpendicular to the centerline 12). This cross-sectional view includes the helical section 14 of the heat exchanger 10. Generally, the first array 108 and the second array 208 are arranged together such that each first passageway 110 is adjacent to at least one second passageway 210 to allow for thermal exchange therebetween. In the specific embodiment shown, the first array 108 in the second array 208 are arranged together such that the first passageways 110 and the second passageways 210 are staggered and alternate moving outwardly in the radial direction ($D_R$) from the centerline 12.

The first passageways 110 and the second passageways 210 have an elongated shape. As shown, the first passageways 110 and the second passageways 210 have a length in the axial direction $D_A$ that is greater than its width in the radial direction $D_R$. In certain embodiments, the first passageways 110 have a length in the axial direction $D_A$ that is at least about twice its width in the radial direction $D_R$, such as at least about four times its width. For example, the first passageways 110 can have a length in the axial direction $D_A$ that is about 3 times to about 10 times its width in the radial direction $D_R$, such as about 4 times to about 8 times its width. Similarly, the second passageways 210 have a length in the axial direction $D_A$ that is at least about twice its width in the radial direction $D_R$, such as at least about four times its width. For example, the second passageways 210 can have a length in the axial direction $D_A$ that is about 3 times to about 25 times its width in the radial direction $D_R$, such as about 4 times to about 20 times its width. As such, the relative contact area between the first passageways 110 and adjacent second passageways 210 can be maximized by an elongated, common wall therebetween.

The first passageways 110 generally define opposite side surfaces 120*a*, 120*b* extending generally in the axial direction $D_A$ and connected to each other by top wall 122 and a bottom wall 124. The opposite side surfaces 120*a*, 120*b* have a generally variable radius from the inner centerline 126 of the first passageway 110. In the embodiment shown, each of the opposite side surfaces 120*a*, 120*b* define a series of waves 128 having a peak 130 and a valley 132 with respect to their distance in the radial direction $D_R$ from the inner centerline 126 of the first passageway 110. Although the opposite side surfaces 120*a*, 120*b* are shown having substantially the same pattern, it is to be understood that the opposite side surfaces 120*a*, 120*b* can have independent patterns from each other. In certain embodiments, the side surface 120*a* has a constantly varying distance in the radial direction $D_R$ from the inner centerline 126 of the first passageway 110, and the side surface 120*b* has a constantly varying distance in the radial direction $D_R$ from the inner centerline 126 of the first passageway 110.

Similarly, the second passageways 210 generally define opposite side surfaces 220*a*, 220*b* extending generally in the axial direction $D_A$ and connected to each other by top wall 222 and a bottom wall 224. The opposite side surfaces 220*a*, 220*b* have a generally variable radius from the inner centerline 226 of the second passageway 210. In the embodiment shown, each of the opposite side surfaces 220*a*, 220*b* define a series of waves 228 having a peak 230 and a valley 232 with respect to their distance in the radial direction $D_R$ from the inner centerline 226 of the second passageway 210. Although the opposite side surfaces 220*a*, 220*b* are shown having substantially the same pattern, it is to be understood that the opposite side surfaces 220*a*, 220*b* can have independent patterns from each other. In certain embodiments, the side surface 220*a* has a constantly varying distance in the radial direction $D_R$ from the inner centerline 226 of the second passageway 210, and the side surface 220*b* has a constantly varying distance in the radial direction $D_R$ from the inner centerline 226 of the second passageway 210.

A divider wall 250 separates each first passageway 110 from adjacent second passageways 210, and physically defines the respective side walls for the first passageway 110 and second passageways 210.

Generally, the heat exchanger 10 is formed via manufacturing methods using layer-by-layer construction or additive fabrication including, but not limited to, Selective Laser Sintering (SLS), 3D printing, such as by inkjets and laser beams, Stereolithography, Direct Selective Laser Sintering (DSLS), Electron Beam Sintering (EBS), Electron Beam Melting (EBM), Laser Engineered Net Shaping (LENS), Laser Net Shape Manufacturing (LNSM), Direct Metal Deposition (DMD), and the like. A metal material is used to form the heat exchanger in one particular embodiment, including but is not limited to: pure metals, nickel alloys, chrome alloys, titanium alloys, aluminum alloys, aluminides, or mixtures thereof.

The heat exchanger 10 is shown in FIGS. 1 and 2 having an outer wall 5 that encases the first fluid path 100 and the second fluid path 200 of the heat exchanger 10, with the respective inlets and outlet providing respective fluid flow through the outer wall. In one embodiment, the heat exchanger 10 is formed as an integrated component. For example, FIGS. 1 and 2 show an exemplary heat exchanger system 10 formed from a single, integrated component, including the outer wall 5, formed via additive manufacturing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A counter-flow heat exchanger defining a centerline, the counter-flow heat exchanger comprising:

a first fluid path, wherein the first fluid path comprises a first supply tube connected to a first transition area separating the first fluid path into a first array of first passageways, wherein the first transition area comprises a series of forks separating the first fluid path into a first array of first passageways, and wherein the first array of first passageways merge at a first converging area into a first discharge tube; and a second fluid path, wherein the second fluid path comprises a second supply tube connected to a second transition area separating the second fluid path into a second array of second passageways, and wherein the second array of second passageways merge at a second converging area into a second discharge tube; and an outer wall encasing the first fluid path and the second fluid path, wherein the first array of first passageways and the second array of second passageways have a substantially helical path around the centerline of the counter-flow heat exchanger, and wherein the first array of first passageways and the second array of second passageways are arranged together such that each first passageway of the first array of first passageways is adjacent to, and alternates with, at least one second passageway of the second array of second passageways, relative to a radial direction of the counter-flow heat exchanger.

2. The counter-flow heat exchanger as in claim 1, wherein the first transition area is positioned at one end of the substantially helical path to supply a first fluid stream into the first array of first passageways, and wherein the second transition area is configured at an opposite end of the substantially helical path to supply a second fluid stream into the second array of second passageways such that the first fluid stream and the second fluid stream circulate the substantially helical path in opposite directions.

3. The counter-flow heat exchanger as in claim 2, wherein the second discharge tube passes through a core defined by the substantially helical path around the centerline of the counter-flow heat exchanger.

4. The counter-flow heat exchanger as in claim 1, wherein each passageway of the first array of first passageways is separated from an adjacent passageway of the second array of second passageways by a dividing wall.

5. The counter-flow heat exchanger as in claim 4, wherein each dividing wall has a first surface that defines a side surface of a passageway of the first array of first passageways and a second surface that defines a side surface of a passageway of the second array of second passageways.

6. The counter-flow heat exchanger as in claim 5, wherein the first surface defines a series of waves, and wherein the second surface defines a series of waves.

7. The counter-flow heat exchanger as in claim 5, wherein the first surface has a constantly varying distance in a radial direction from the centerline of the counter-flow heat exchanger.

8. The counter-flow heat exchanger as in claim 1, wherein the first array of first passageways have an elongated shape.

9. The counter-flow heat exchanger as in claim 1, wherein the first array of first passageways define a cross-section having a length in an axial direction and a width in a perpendicular radial direction, with the length being at least twice the width.

10. The counter-flow heat exchanger as in claim 1, wherein the second array of second passageways have an elongated shape.

11. The counter-flow heat exchanger as in claim 6, wherein the second array of second passageways define a cross-section having a length in an axial direction and a width in a perpendicular radial direction, with the length being at least twice the width.

12. The counter-flow heat exchanger as in claim 1, wherein the second transition area comprises a series of forks separating the second fluid path into a second array of second passageways.

13. The counter-flow heat exchanger as in claim 1, wherein the counter-flow heat exchanger comprises a metal material, and wherein the first fluid path and the second fluid path are not in fluid communication.

14. The counter-flow heat exchanger as in claim 13, wherein the metal material comprises a nickel alloy, a chrome alloy, a titanium alloy, an aluminum alloy, an aluminide, or mixtures thereof.

15. The counter-flow heat exchanger as in claim 1, wherein the second array of second passageways define a cross-section having a length in an axial direction and a width in a perpendicular radial direction, with the length being 3 to 25 times the width.

16. The counter-flow heat exchanger as in claim 15, further comprising:

a hot inlet extending through the outer wall and attached to the first supply tube;

a first exit extending through the outer wall and attached to the first discharge tube;

a cold inlet extending through the outer wall and attached to the second supply tube; and a second exit extending through the outer wall and attached to the second discharge tube.

17. The counter-flow heat exchanger as in claim 11, wherein a first fluid flowing through the first fluid path has an initial temperature and a discharge temperature, and wherein the discharge temperature is about 90% of the initial temperature or lower, wherein the first array of first passageways define a cross-section having a length in an axial direction and a width in a perpendicular radial direction, with the length being 3 to 10 times the width.

18. A counter-flow heat exchanger defining a centerline, the counter-flow heat exchanger comprising:

a first fluid path, wherein the first fluid path comprises a first supply tube connected to a first transition area separating the first fluid path into a first array of first passageways, wherein the first transition area comprises a series of forks separating the first fluid path into a first array of first passageways, and wherein the first array of first passageways merge at a first converging area into a first discharge tube; and a second fluid path, wherein the second fluid path comprises a second supply tube connected to a second transition area separating the second fluid path into a second array of second passageways, and wherein the second array of second passageways merge at a second converging area into a second discharge tube, wherein the first array of first passageways and the second array of second passageways have a substantially helical path around the centerline of the counter-flow heat exchanger, and wherein the first array of first passageways and the second array of second passageways are arranged together such that each first passageway of the first array of first passageways is adjacent to at least one second passageway of the second array of second passageways, and wherein the first array of first passageways and the second array of second passageways are arranged together such that they alternate moving outwardly in the radial direction from the centerline.

19. A counter-flow heat exchanger defining a centerline, the counter-flow heat exchanger comprising:

a first fluid path, wherein the first fluid path comprises a first supply tube connected to a first transition area separating the first fluid path into a first array of first passageways, wherein the first transition area comprises a series of forks separating the first fluid path into a first array of first passageways, and wherein the first array of first passageways merge at a first converging area into a first discharge tube;

a second fluid path, wherein the second fluid path comprises a second supply tube connected to a second transition area separating the second fluid path into a second array of second passageways, and wherein the second array of second passageways merge at a second converging area into a second discharge tube; and an outer wall encasing the first fluid path and the second fluid path, wherein the first array of first passageways and the second array of second passageways have a substantially helical path around the centerline of the counter-flow heat exchanger, and wherein the first array of first passageways and the second array of second passageways are arranged together such that, the first fluid path and the second fluid path do not physically mix with each other.

20. The counter-flow heat exchanger of claim 19, wherein the first fluid path, the second fluid path, and the outer wall encasing the first fluid path and the second fluid path are formed using additive manufacturing.

* * * * *